US008985224B1

(12) United States Patent
Stone

(10) Patent No.: US 8,985,224 B1
(45) Date of Patent: Mar. 24, 2015

(54) INTERNAL BIDIRECTIONAL TUBING PLUG

(75) Inventor: William Bundy Stone, Tulsa, OK (US)

(73) Assignee: New Product Engineering, Inc., Tulsa, OK (US)

( * ) Notice: Subject to any disclaimer, the term of this patent is extended or adjusted under 35 U.S.C. 154(b) by 473 days.

(21) Appl. No.: 13/403,009

(22) Filed: Feb. 23, 2012

(51) Int. Cl.
*E21B 33/12* (2006.01)

(52) U.S. Cl.
CPC ..... *E21B 33/12* (2013.01)
USPC ..... 166/377; 166/188

(58) Field of Classification Search
CPC ... E21B 33/12; E21B 33/1208; E21B 33/128; E21B 33/13
USPC ..... 166/377, 179, 128, 131, 135, 142, 143, 166/188, 155
See application file for complete search history.

(56) References Cited

U.S. PATENT DOCUMENTS

2004/0118569 A1* 6/2004 Brill et al. ..... 166/380
2011/0073329 A1* 3/2011 Clemens et al. ..... 166/387

* cited by examiner

*Primary Examiner* — Brad Harcourt
*Assistant Examiner* — Steven MacDonald
(74) *Attorney, Agent, or Firm* — Molly D. McKay

(57) ABSTRACT

An internal bidirectional tubing plug for plugging a well to prevent well fluids from passing the plug in a well conduit until the internal components of the plug are pumped out of its body. The body of the plug connects to the well's tubing string. The body holds a petal assembly consisting of several petals and a tapered cork assembly located within an opening formed by the petals. Both assemblies are sandwiched between upper and lower pistons. Hydrostatic pressure on the bottom of the plug as it is lowered into the fluid filled well holds the petals within the body. The internal components of the plug are removed from the body by applying hydraulic pressure in the upper area of the plug. This causes the plug to fail at a recess provided in the cork, resulting in the two assemblies and the pistons being forced out of the body.

13 Claims, 23 Drawing Sheets

INTERNAL BIDIRECTIONAL TUBING PLUG

BACKGROUND OF THE INVENTION

1. Field of the Invention

The present invention is a closure means for well conduits in the form of an internal bidirectional tubing plug. The plug prevents well fluids from passing the plug in either direction in a well conduit until the plug is activated and pumped apart, and the pieces that comprise the plug are either pumped down or up a tubing string or down or up a casing or tubing annulus of the well or fall to the bottom of the well. The plug is activated or deconstructed in situ through application of hydraulic pressure on the top side of the plug.

2. Description of the Related Art

The present invention relates to closure means for well conduits. More particularly, it relates to temporary plugs that are removable without mechanical intervention from the surface above the well. Plugs are used to run new or used tubing, known as a work string, into a well filled with well fluids, usually drilling mud or water. The tubing is run behind a drill bit and drill collar, behind a packer or open ended as fast and as safely as possible. As the tubing is run into the well, the displaced well fluid is directed to a pit or tank while preventing the well fluid from entering the tubing, through a bit, a packer, or through an open end.

It is also desirable to prevent displaced well fluids from being displaced out the surface open end of the tubing into the atmosphere. The displaced well fluids will take the path of least resistance to the atmosphere. If the displaced well fluids are allowed to enter the tubing, well fluids will "spray" out the surface open end of the tubing. This spray of well fluids will coat the rig, rig crew, stripping rubber, blow out preventers, wellhead, and the ground and will generally impair safe working conditions. The spray may also contaminate the ground or create a fire or chemical hazard since some well fluids contain hazardous chemicals and compounds.

In general practice the tubing is lowered very slowly into a well to allow the well fluids to drain from the tubing/annulus casing valve, and slow enough to prevent well fluids from spraying out the open end of the tubing. This method of running a tubing string very slowly is costly to well operators due to the additional rig time. It is desirable to run the tubing as fast as possible, in a safe manner, to reduce the well operators cost.

One problem is controlling the well fluids from being displaced from the tubing/casing annulus while the tubing is being lowered into the well. This is accomplished by using a "stripping rubber", as known in the art. The stripping rubber effectively seals the tubing/casing annulus diverting all displaced well fluids up the tubing and out the casing valve at the same time. The casing valve is generally placed on a kill-choke/spool below the blow out preventers. The casing valve is generally opened to a flow line ending at a flow back tank, frac tank, and or an earth pit. The flow lines that are directed to a flow back tank generally have sufficient restriction in them to not be able handle all of the displaced well fluids through the casing valve which causes more of the displaced well fluids to be directed into the tubing and out the end of it at the surface.

A second problem is that if the well operator chooses to run a stripping rubber and a drill pipe float valve above the bit, i.e. essentially a check valve, all displaced well fluids will be diverted to the casing valve and to a tank or pit. But using a drill pipe float valve causes another problem.

A third problem is that when using a drill pipe float valve and stripping rubber circulation of the well fluid may only occur down the tubing and up the tubing/casing annulus. There are situations where this setup may limit the control of the well by not allowing well fluids to be circulated down the tubing/casing annulus and up the tubing.

A fourth problem is that when using a drill pipe float valve with a stripping rubber and drilling out any obstructions in a well such as DV tools (known as stage cementing tools), DV rubbers, primary cementing rubbers and any excess cement left in the well, a high circulation rate is necessary to carry all drilled and washed debris up the tubing/casing annulus through the casing valve, flow line, and to a wash tank. If the casing valve or flow line become plugged circulation up the tubing/casing will be lost. If circulation is lost the annulus debris in the annulus will fall down hole around the tubing "sticking" the tubing. To remove the tubing a "fishing" job is required that is very expensive and for this reason this set up is not used by prudent operators.

A fifth problem is created when using a wire line (also known as "slick line") retrievable "blanking plug". One way to prevent well fluids from entering the tubing is to run a wire line retrievable blanking plug in a tubing nipple at or above the bottom end of the tubing. A retrievable blanking plug seals off fluid flow in both directions of the tubing. With a blanking plug in place while running the tubing, in conjunction with a stripping rubber, all displaced fluids are diverted through a casing valve. While picking up a new or used work string and running it into the well, there will be mill scale, rust, dirt, tubing dope, and all manner of debris that will fall down the tubing and land on top of the blanking plug.

Once the tubing is at depth the tubing is filled with fluid to equalize differential pressure across the retrievable blanking plug so that it may be removed from the tubing. This is accomplished by running a wireline blanking plug retrieval tool, and in some cases, an equalizing prong, to release the retrievable blanking plugs latching members from a tubing sub known as a nipple. However, in most cases tubing debris, as mentioned above, have fallen down and covered the retrievable blanking plug such that the retrievable tool and equalizing prong cannot engage the blanking plug to equalize, release, and pull it from the tubing to the surface. At this time the debris must be washed off the retrievable blanking plug before it is pulled from the tubing. This may be accomplished by using coiled tubing and or snubbing operations or other methods, which incur additional cost and time. Sometimes the fluid laden tubing must be pulled from the well. Experience has shown that using a retrievable blanking plug is not a cost effective way to prevent well fluids from entering a tubing string.

A sixth problem occurs when running a "pump-out-plug". The pumped-out portion of the pump-out-plug has an outside diameter greater than the internal diameter of the tubing, and therefore, it may not be circulated out of the well up the tubing. Further, the outside diameter of the pumped-out portion of the pump-out-plug is generally of a dimension that prevents is from being circulated from the well up the tubing/casing annulus. Additionally the pumped-out portion of a pump-out-plug is normally made from a metal, generally aluminum, which will fall on top of any cased-hole tools below the pump-out-plug and prevent them from being pulled from the well at a later date. The metal pumped-out portion may become wedged between the casing internal surface and the outer surface of the cased-hole tools (known as retrievable packers, retrievable bridge plugs, and others). Therefore, in general, pump-out-plugs are only run in a well at the bottom end of a tubing string, sometimes below a retrievable packer, and the pumped-out portion of the pump-out-plug falls into the rat hole at the bottom of the well. Pump-out-plugs are not compatible and with a drill bit.

A seventh problem occurs when running a "rupture disk". A rupture disk is run above the bit and drill collars in the tubing in a tubing nipple or a J-J (the small internal area in a tubing collar between the two pin ends of tubing) to prevent well fluid from entering the tubing when it is run into a well that is full of well fluid. When it is time to establish circulation the tubing is filled with fluid and pressure applied on top of the rupture disk, thereby rupturing it and establishing circulation in the well. The debris left in the J-J or tubing nipple of the rupture disk are protrusions into the internal diameter of the tubing string. These protrusions may hang debris circulated up the tubing and plug it off, causing the operator to pull the work string. Many times surface intervention may be required to pierce the rupture disk to facilitate rupturing it. Experience has shown that the use of a rupture disk is fraught with potential problems and unnecessary expense.

An eight problem occurs when lowering tubing into a well with drilling mud that contains lost circulation material, such as cotton seed hulls, walnut chunks, cellophane particles, etc. Experience has shown that the lost circulation material, when entering the bit, may plug it off, or may plug off the tubing above the bit. This situation reminds us that under these circumstances it is generally a good idea to run some type of tubing plugging apparatus.

The present invention addresses these problems. A primary object of the present invention is to prevent well fluids from entering the tubing as it is lowered into a well full of fluid.

A second object of the invention is to remove the plugging apparatus with well fluids leaving no debris in the tubing.

A third object of the invention is to remove the plugging apparatus without surface intervention.

A fourth object of the invention is to be able to establish circulation at any time, allowing the operator full control of the well.

A fifth object of the invention is to allow the well operator, when pumping out the plugging apparatus, to monitor the tubing pressure at the surface, to identify when the internal bidirectional tubing plug has released by observing a pressure build up and fall off, and then establish that the well is circulating.

A sixth object of the invention is to leave the internal diameter of the tubing constant when the plugging apparatus is removed.

A seventh object of the invention is to blank off the tubing with very small parts that may be circulated through a workover bit, up the tubing/casing annulus, or through the workover bit up the tubing to the surface.

An eighth object of the invention is to manufacture the small parts of this plugging apparatus from material recognized as biodegradable.

A ninth object of this invention is to manufacture the internal parts of this plugging apparatus of a material that is sufficient for the pressures and temperatures encountered in most well conditions.

A tenth object of this invention is to manufacture the parts of this plugging apparatus from a material that is easily drillable.

SUMMARY OF THE INVENTION

The invention is an internal bidirectional tubing plug for plugging a well. The plug is housed in a body that connects on its ends to the well's tubing string. The body has a petal recess for receiving a petal assembly and a cork assembly. Upper and lower pistons are provided on the top and bottom, respectively, of the petal and cork assemblies.

The petal assembly consists of several, generally four in number, identical petals that are adjacent each other, fifth and sixth petals that are located adjacent to and on either side of the identical petals, and a seventh or keystone petal that is located between the fifth and sixth petals. The petals jointly form a hole in the petal assembly into which the cork assembly is received.

The purpose and function of the internal bidirectional tubing plug is to prevent well fluids from passing the plug in a well conduit, in either direction, within a well until the plug is activated or deconstructed and pumped apart so that the pieces that comprise the plug are either pumped down or up a tubing string or down or up a casing or tubing annulus of the well.

As the plug is lowered into the fluid filled well, a hydrostatic pressure pushes against the lower piston which in turn transfers the pressure onto the petal assembly and to an upper lip of the body of the plug. The tapered outside shape of the cork directs additional force onto the petal assembly and the body of the plug.

The plug is activated, released or deconstructed by applying hydraulic pressure applied in upper area of the plug. This forces the cork to fail at a recess provided in the cork, allowing the bottom portion of the cork to be pushed out of the bottom of the body along with the lower piston. Once the bottom portion of the cork is gone, hydraulic forces next causes the keystone petal to be forced out of the body, followed by the remaining petals, the upper piston and the nut that holds the broken top of the cork.

DETAILED DESCRIPTION OF THE PREFERRED EMBODIMENT

Figure 1:
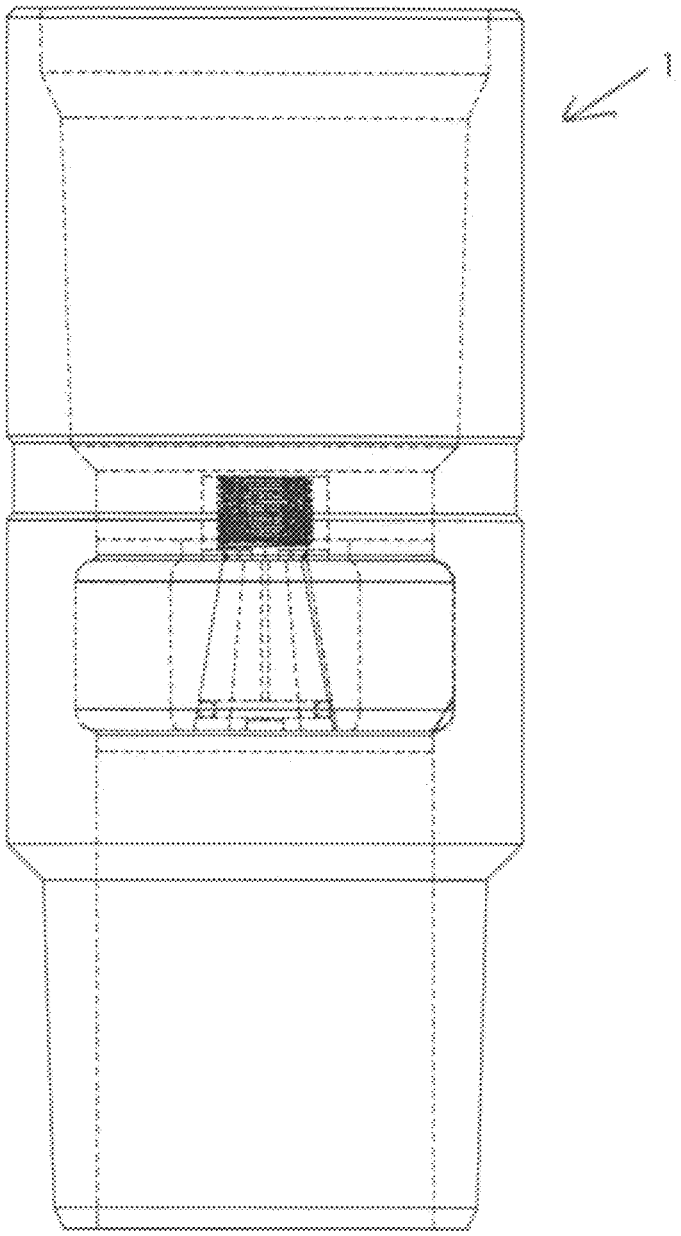
FIG. 1 is a front view with hidden lines shown of the internal bidirectional tubing pug.
Figure 2:
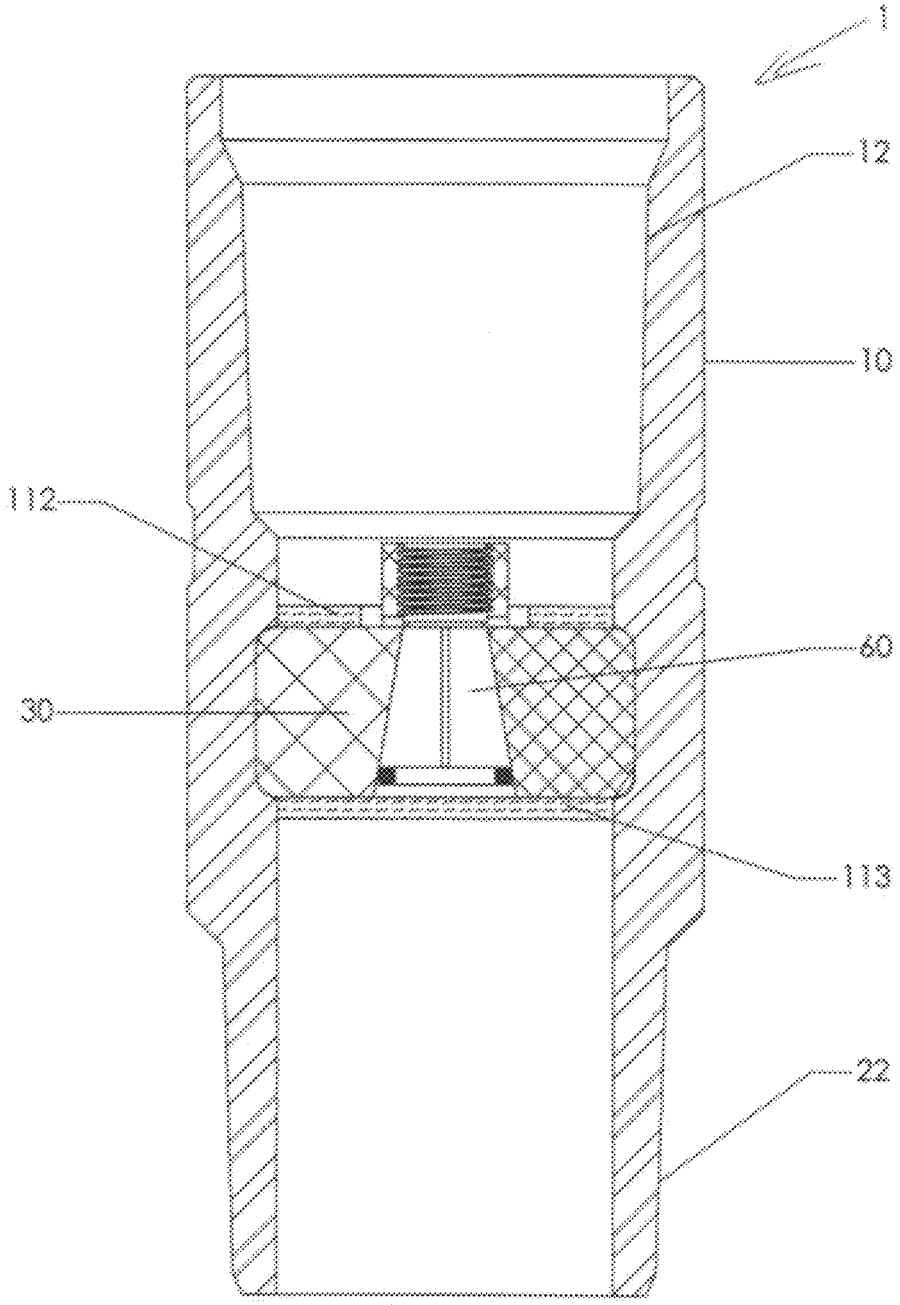
FIG. 2 is a front cross section view of FIG. 1, except the cork is not shown in cross section.
Figure 3:
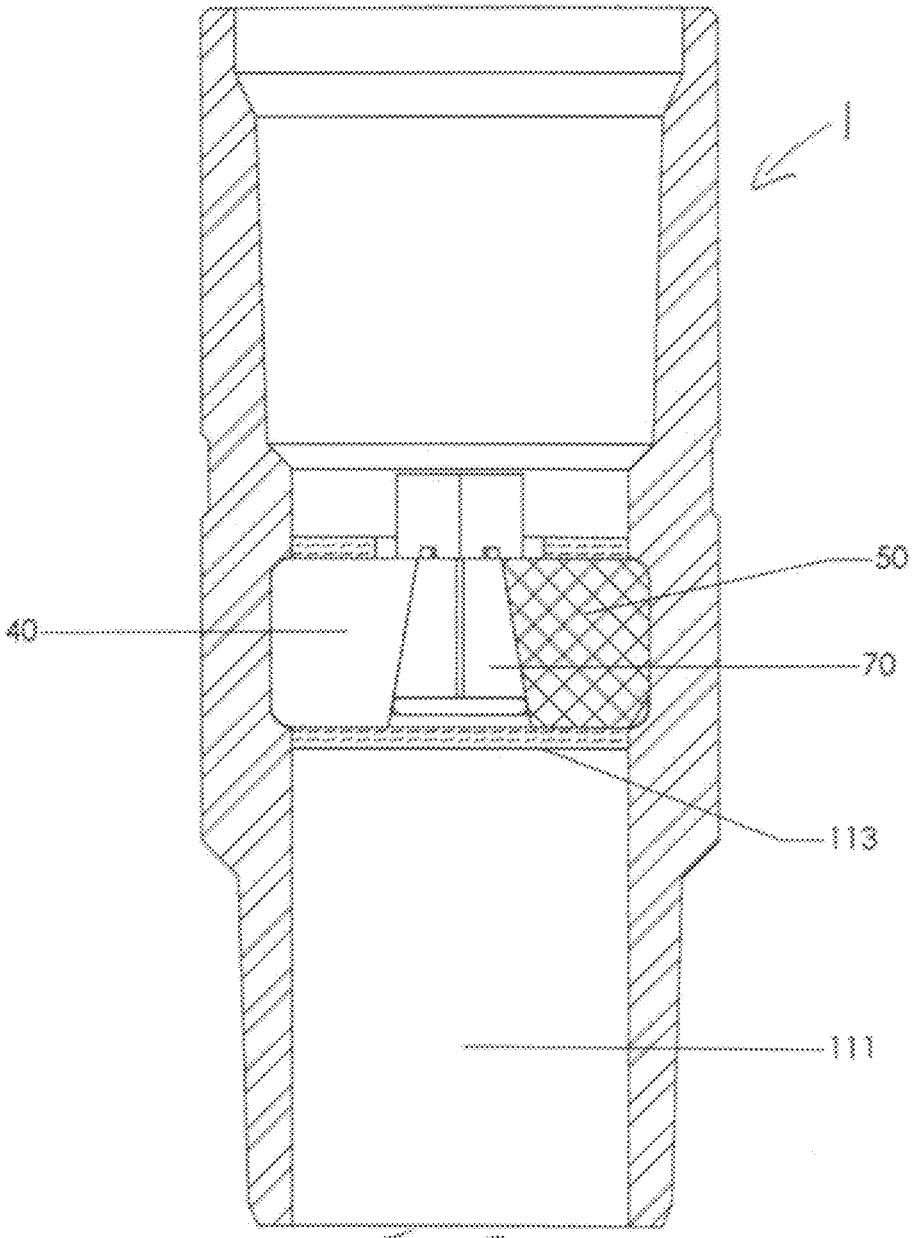
FIG. 3 is a front cross section view of FIG. 1, except the nut, cork, and O-ring are not shown in cross section.

Referring now to the drawings and initially to FIGS. 1-3, there is illustrated an internal bidirectional tubing plug 1 that is constructed in accordance with a preferred embodiment of the present invention.

Figure 7:
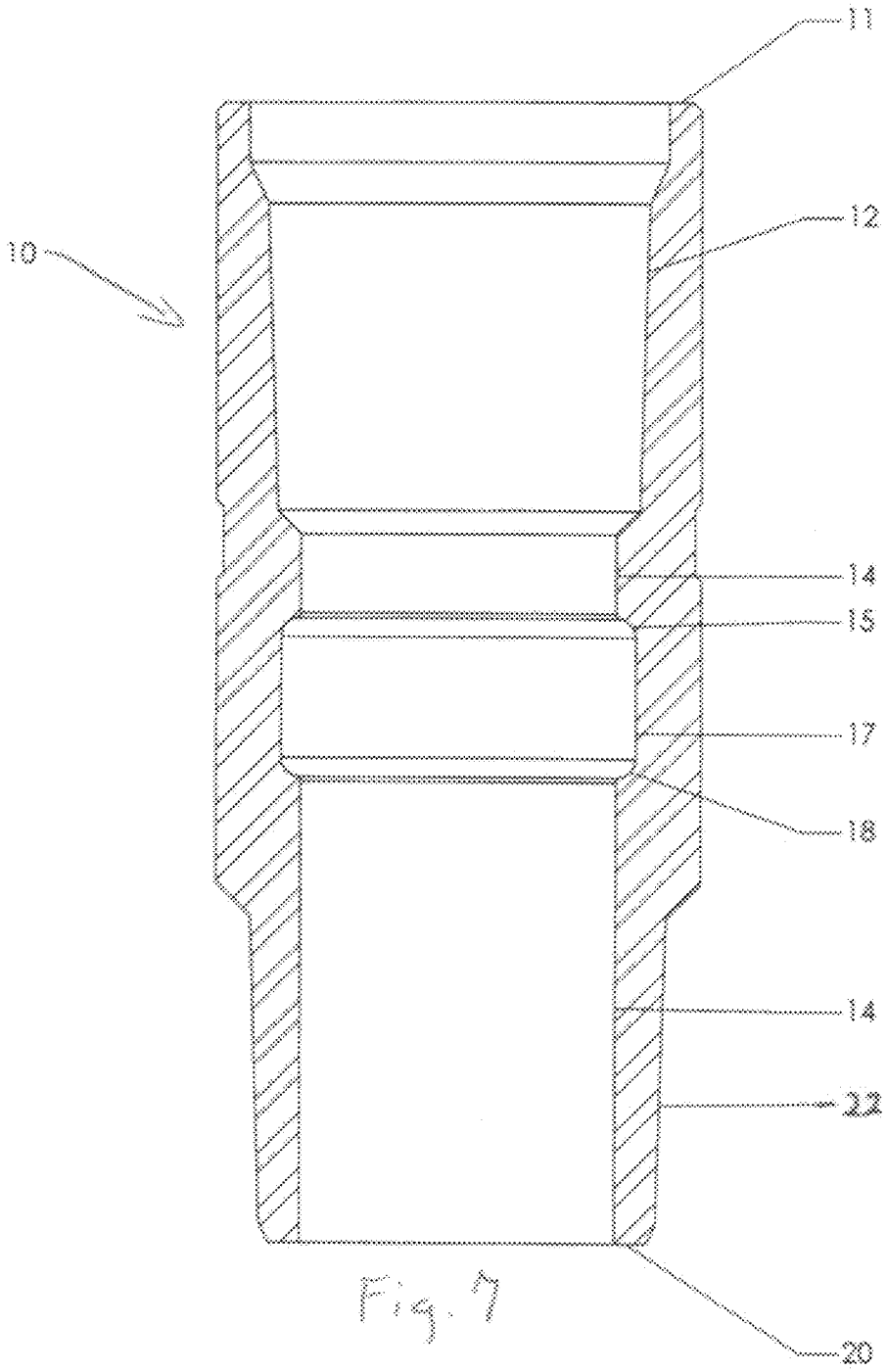
FIG. 7 is a front cross section view of the body of the plug after the contents have been flushed down and out of the plug.
Figure 8:
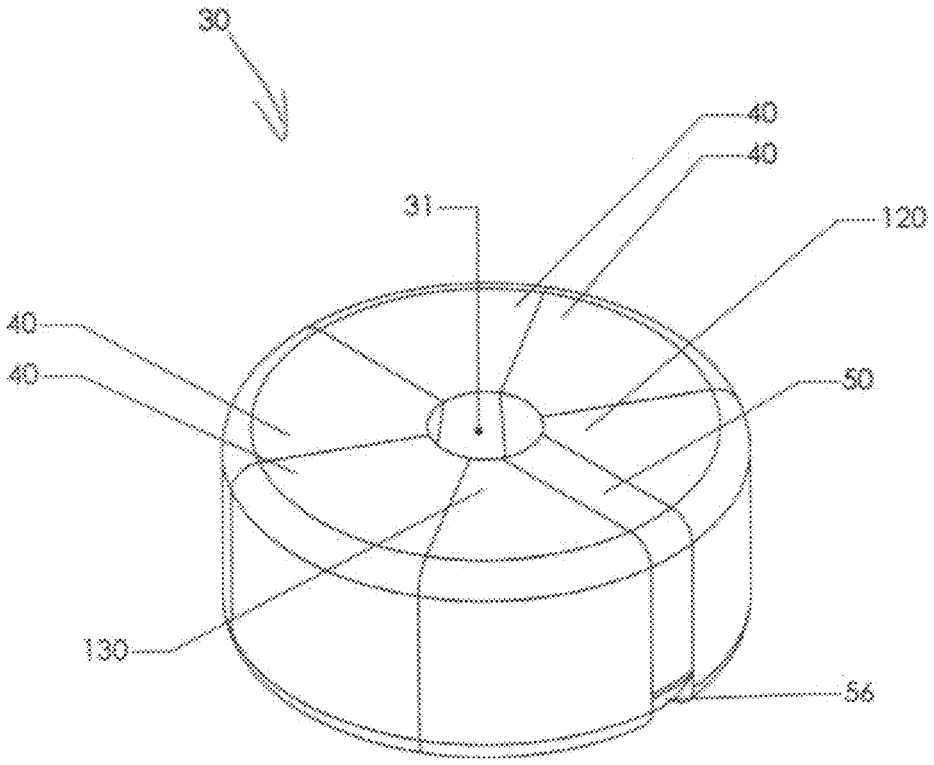
FIG. 8 is an isometric view of the petal assembly of the plug of FIG. 1.

Referring also to FIG. 7, the plug 1 is housed in a body 10. The body 10 has a top 11, a box connection 12, an inside diameter 14, an upper lip 15, a petal recess 17, a lower lip 18, a pin connection 22 and a bottom 20. Referring to FIG. 2, the body 10 of the plug 1 contains a cork assembly 60, a petal assembly 30, an upper piston 112, and a lower piston 113.

Referring to FIGS. 8-12A, the petal assembly 30 consists of four identical petals 40 that are adjacent each other, a fifth petal 120 that is located adjacent the four identical petals 40, a sixth petal 130 that is also located adjacent the four identical petals 40, and a seventh or keystone petal 50 located between the fifth and sixth petals 120 and 130. The petals 40, 120, 130, and 50 jointly form a hole 31 in the petal assembly 30 for receiving the cork assembly 60.

Although the petal assembly 30 is illustrated and described herein as containing four identical petals 40, the invention is not so limited. Therefore, there may be more or less than four identical petals 40 employed in various embodiments of the invention, depending on the size of the plug 1.

Figure 9:
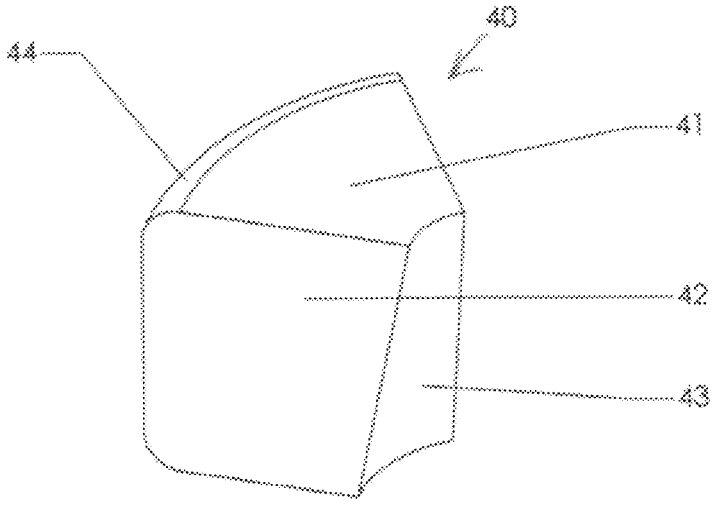
FIG. 9 is an isometric view of one of the four identical petals of the petal assembly of FIG. 8.
Figure 9A:
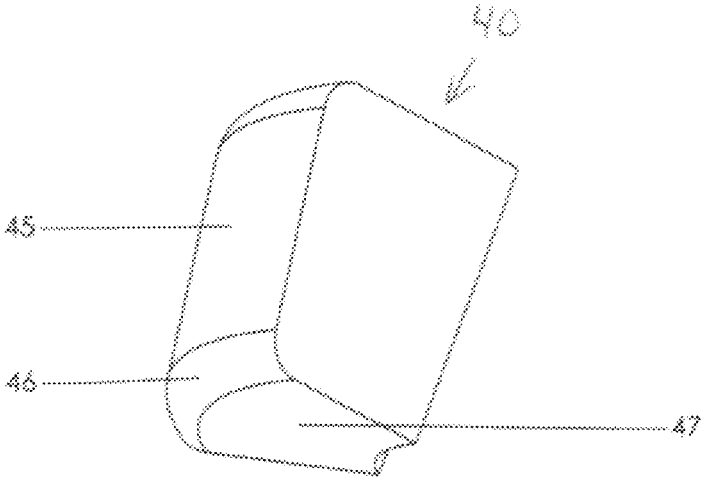
FIG. 9A is a rotated view of the petal of FIG. 9.
Figure 10:
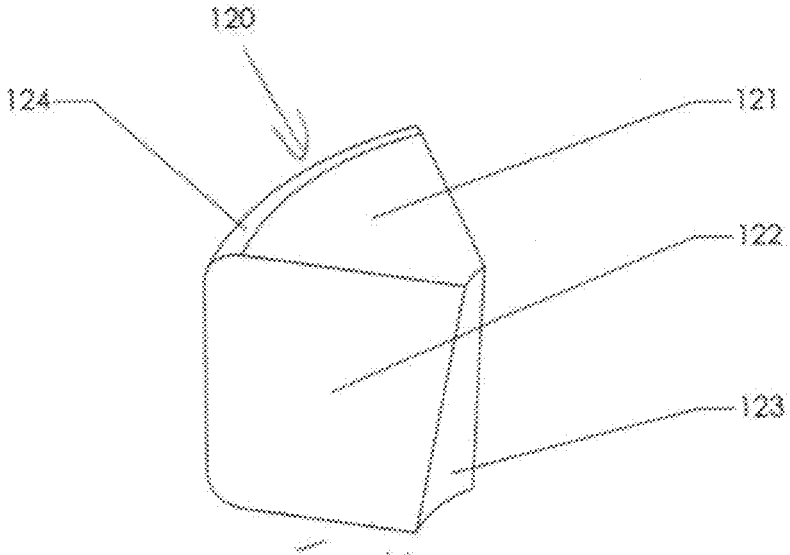
FIG. 10 is an isometric view of the fifth petal of the petal assembly of FIG. 8.
Figure 10A:
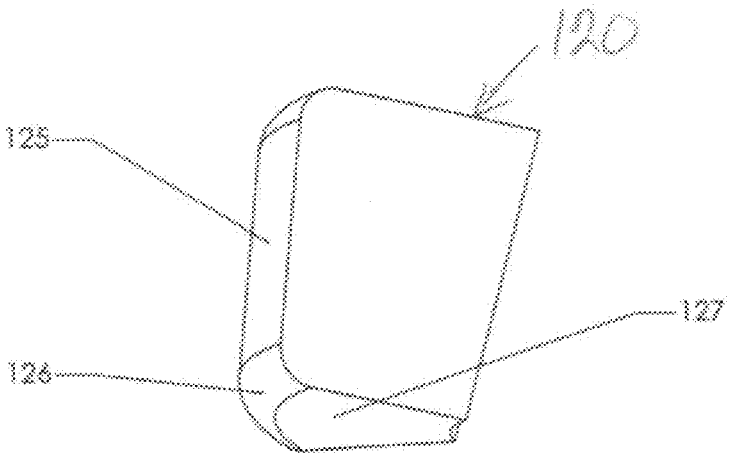
FIG. 10A is a rotated view of the fifth petal of FIG. 10.
Figure 11:
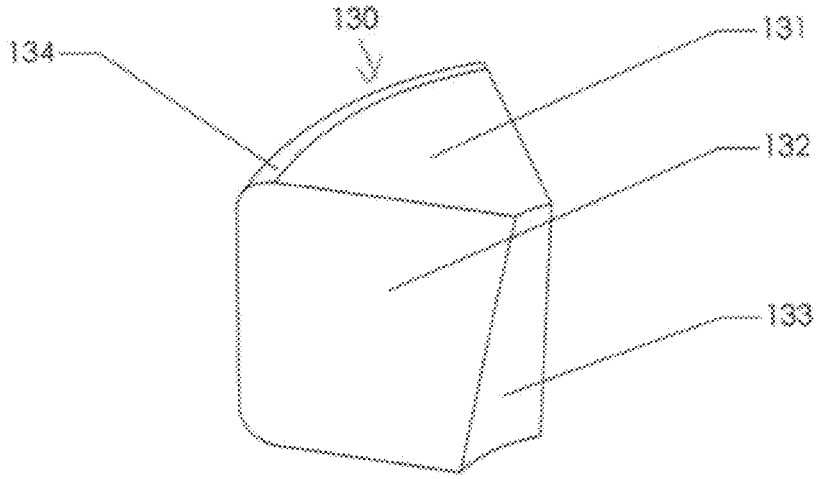
FIG. 11 is an isometric view of the sixth petal of the petal assembly of FIG. 8.
Figure 11A:
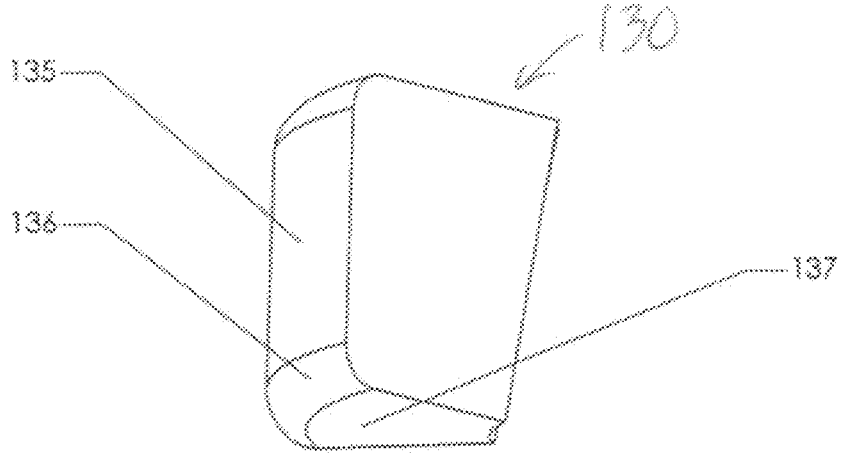
FIG. 11A is a rotated view of the sixth petal of the FIG. 11.
Figure 12:
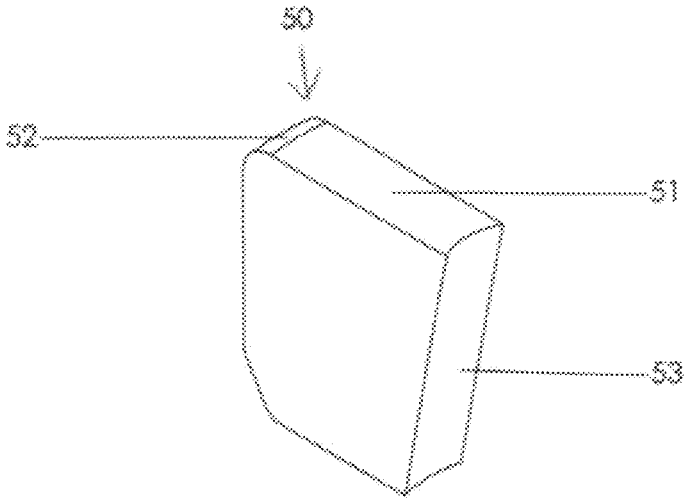
FIG. 12 is an isometric view of the keystone petal of the petal assembly of FIG. 8.
Figure 12A:
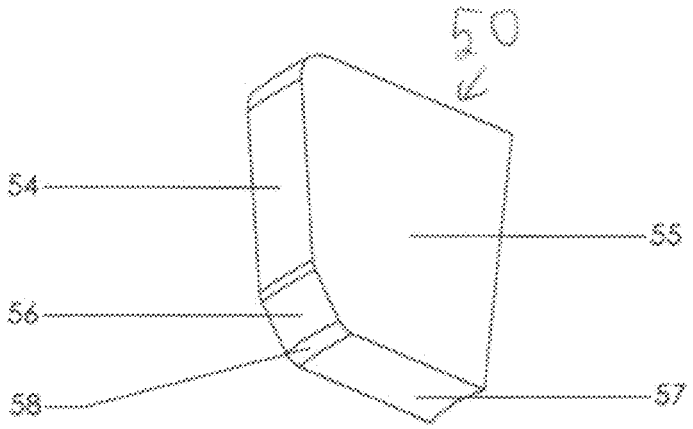
FIG. 12A is a rotated view of the keystone petal of FIG. 12.

Referring to FIGS. 9 and 9A, the four identical petals 40 each are provided with a top side 41, a tapered conical inner surface 43, an upper edge 44, a back 45, a lower edge 46 and a bottom 47. Referring to FIGS. 10 and 10A, the fifth petal 120 is provided with a top 121, sides 122, a tapered conical inner surface 123, an upper edge 124, a back 125, a lower edge 126, and a bottom 127. Referring to FIGS. 11 and 11A, the sixth petal 130 is provided with a top 131, sides 132, a tapered conical inner surface 133, an upper edge 134, a back 135, a lower edge 136 and a bottom 137. Finally, referring to FIGS. 12 and 12A, the keystone petal 50 is provided with a top 51, a tapered conical inner surface 53, an upper edge 52, a back 54, an angled bevel 56 located at a lower end of the back 54, an inner lip 58, a bottom 57 and sides 55.

Figure 13:
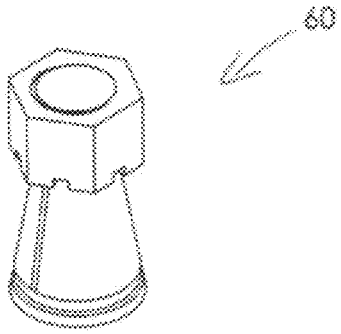
FIG. 13 is an isometric view of the cork assembly from the plug of FIG. 1.
Figure 13A:
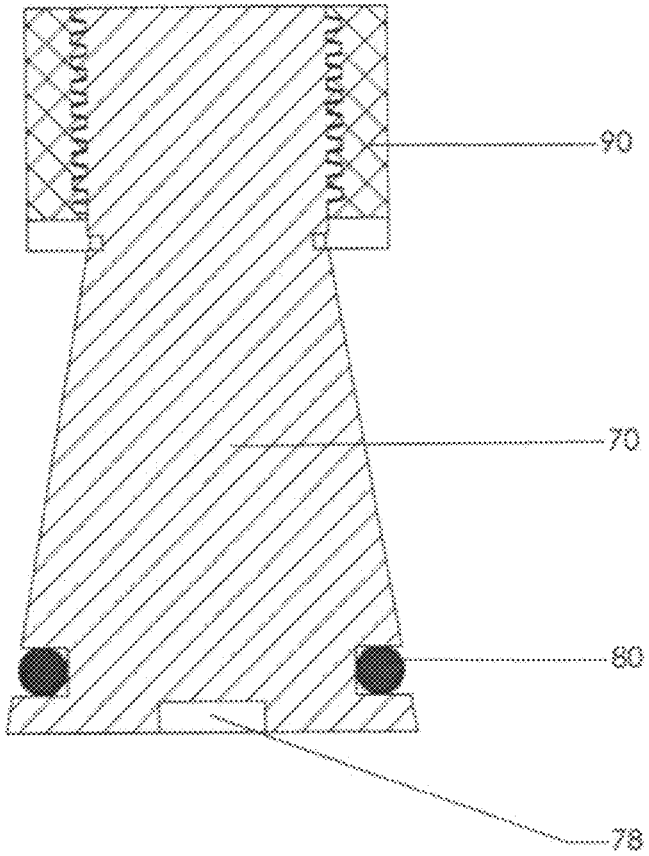
FIG. 13A is a front cross sectional view of the cork assembly of FIG. 13.
Figure 14:
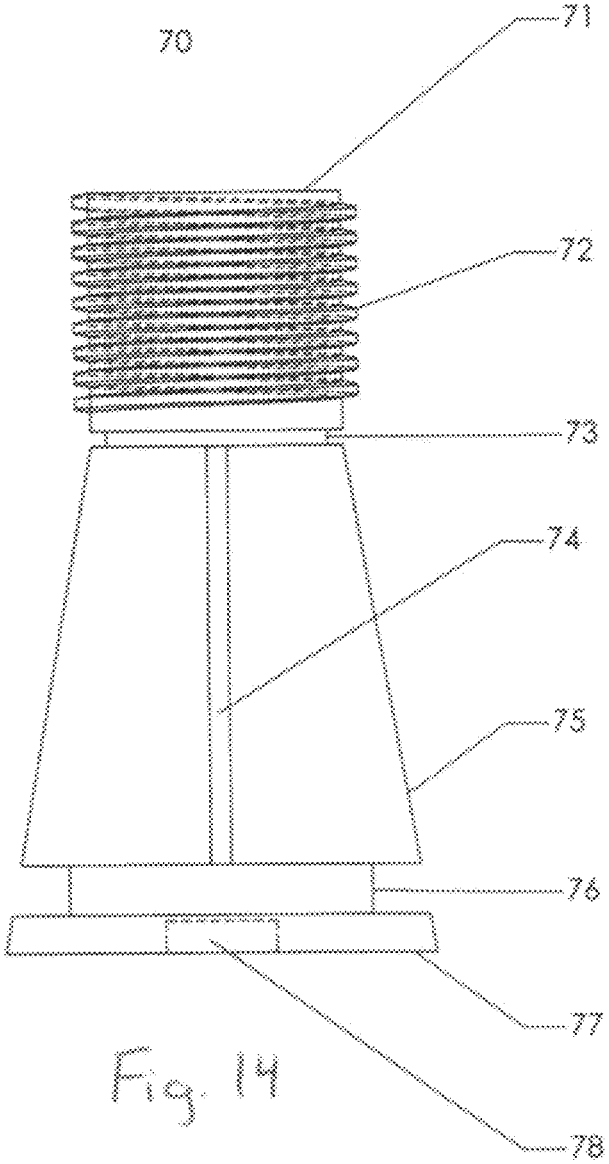
FIG. 14 is a front view of the cork of FIG. 13 with hidden lines shown.

Referring to FIGS. 13, 13A and 14, the cork assembly 60 consists of a nut 90, a cork 70 and an o-ring 80. The cork 70 has a top 71, threads 72, a recess 73, a fluid groove 74, a tapered outside frusto-conical surface 75, an o-ring groove 76, a bottom 77, and a slot 78 used to screw the cork 70 into the nut 90, as will be described more fully hereafter.

Figure 15:
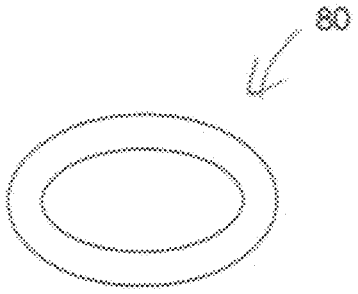
FIG. 15 is an isometric view of the o-ring of the plug of FIG. 1.
Figure 15A:
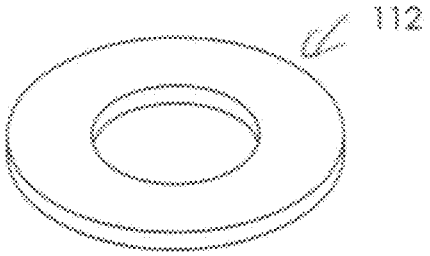
FIG. 15A is an isometric view of the upper piston of the plug of FIG. 1.
Figure 15B:
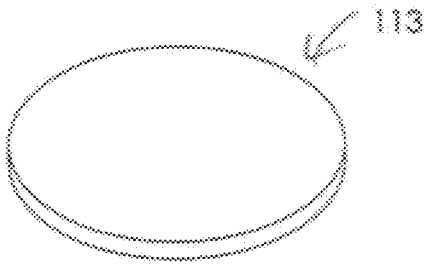
FIG. 15B is an isometric view of the lower piston of the plug of FIG. 1.

The o-ring 80 which is illustrated in FIG. 15 is received in the o-ring groove 76 of the cork assembly 60, as shown in FIG. 14. Also, the upper and lower pistons 112 and 113, which are shown in FIGS. 15A and 15B, respectively, attached to the top and bottom, respectively, of the petal assembly 30.

Figure 16:
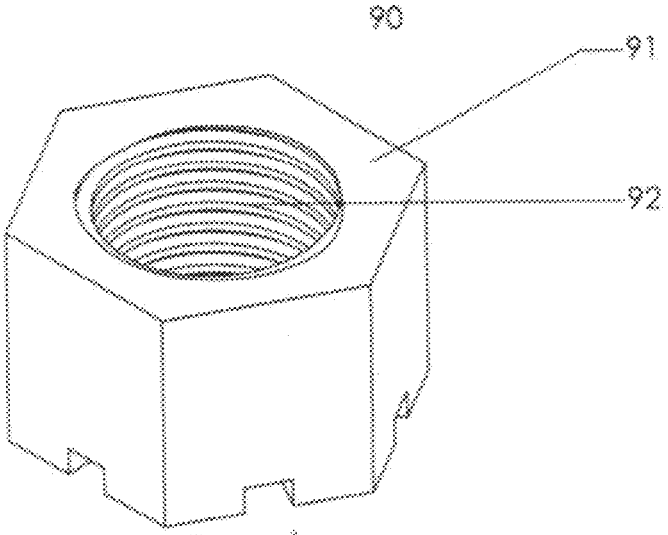
FIG. 16 is an enlarged isometric view of the nut of the cork assembly of FIG. 13.
Figure 16A:
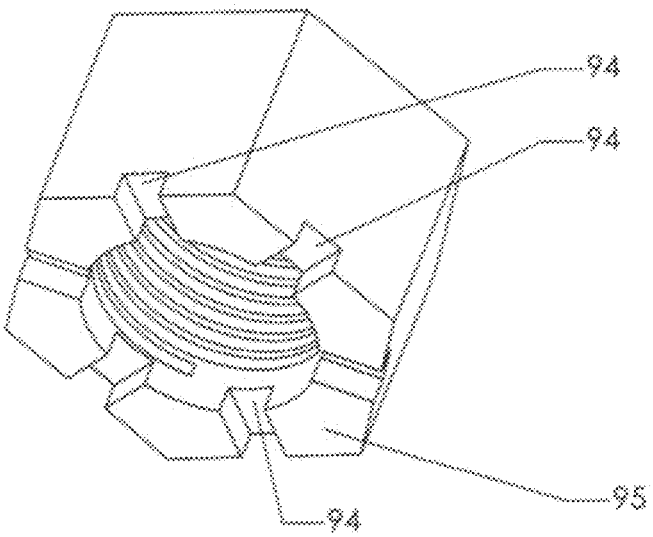
FIG. 16A is a rotated view of the nut of FIG. 16.

Referring for FIGS. 16 and 16A, the nut 90 is provided with threads 92 that match in mating fashion with the threads 72 of the cork 70. The slots 94 in the nut 90 direct hydraulic pressure to the fluid groove 74 of the cork 70. The bottom 95 of the nut 90 rests against the top of the petal assembly 30 of the plug 1, as best shown in FIGS. 2 and 4A.

The purpose and function of the internal bidirectional tubing plug 1 is to prevent well fluids from passing the plug 1 in a well conduit, in either direction, within a well until the plug 1 is activated and pumped apart so that the pieces that comprise the plug are either pumped either down or up a tubing string or down or up a casing or tubing annulus of the well as will be more fully explained hereafter.

The pin connection 22 of the body 10 screws into a tubing string (not illustrated) which generally is above the bit and drill collars, and a pin connection (not illustrated) of the tubing string screws into the box connection 12 of the plug 1. The tubing and the attached plug 1 are then lowered into the fluid filled well and the plug 1 prevents well fluid from entering the tubing. Although not illustrated, as the tubing is lowered into the well, the tubing's outside volume is displaced up the tubing/casing annulus against a stripper rubber and displaced well fluids are forced out of the well through a casing valve to a pit.

As the plug 1 is lowered into the fluid filled well, a hydrostatic pressure is developed in lower area 111 within the body 10, as seen in FIG. 3, generating a force which acts against the lower piston 113, which in turn acts upon the bottoms 47 of the four identical petals 40, upon the bottom 57 of the keystone petal 50, upon the bottom 127 of the fifth petal 120, upon the bottom 137 of the sixth petal 130, and upon the bottom 77 of the cork 70 which transfers this force into the upper lip 15 of the body 10. In addition, the force generated on the bottom 77 of the cork 70 due to the tapered outside frusto-conical surface 75 of the cork 70 directs the vertical and horizontal components of the force generated on the cork 70 through the four identical petals 40, through the fifth petal 120, through the sixth petal 130, and through the keystone petal 50 outward into the petal recess 17 of the body 10 and upward into the upper lip 15 of the body 10.

The release or activation of the plug 1 will now be described. Once the tubing and plug 1 reach working depth, well fluids are pumped into the tubing string to equalize the hydrostatic pressure across the plug 1 from the top 11 to the bottom 20 of the body 10. To release the plug 1, hydraulic pressure in the form of extra hydrostatic pressure or applied hydraulic pressure at the well surface is applied in upper area 110 of the plug 1. Some wells don't stand full of fluid and just dumping enough fluid above them, filling the tubing to a sufficient level of fluid will generate enough hydrostatic or hydraulic pressure to release the plug. Other wells are full and the operator will have to apply pump pressure at the surface to pump the plug loose.

Figure 4:
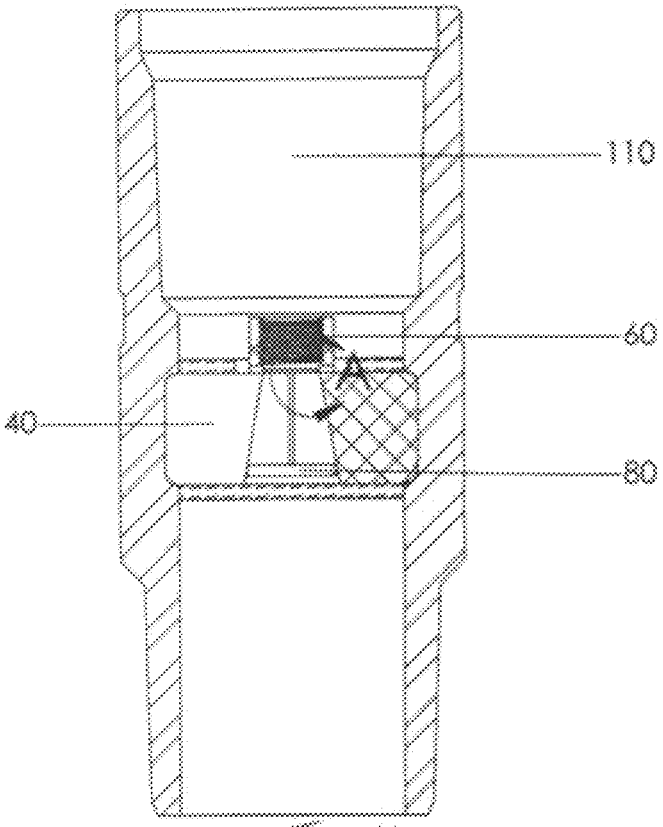
FIG. 4 is a front cross section view of the body, nut, keystone petal, and upper and lower piston of FIG. 1.
Figure 4A:
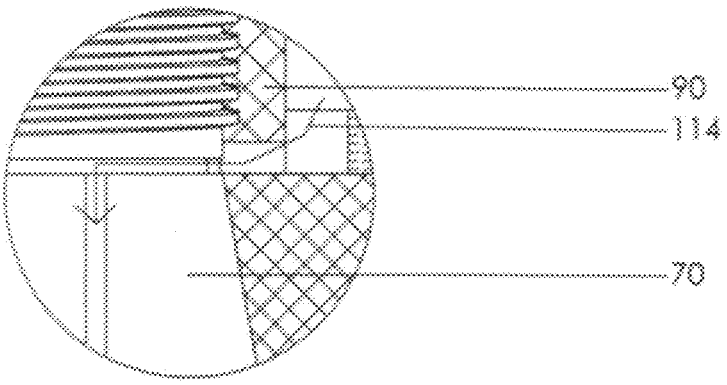
FIG. 4A is an enlarged view of the area contained within circle A of FIG. 4 to shown a close up view of the nut, cork, keystone petal and upper piston.

As shown in FIGS. 4 and 4A, applied hydraulic pressure acts through fluid path 114, that exerts hydraulic pressure on an area as defined by outside diameter of o-ring 80, that exerts a downward force opposing an upward force defined by the area of the recess 73 of the cork's outside diameter and by the mechanical properties of the material from which the cork 70 is constructed and which is held by the nut 90. When the downward forces exceed the upward forces, the cork 70 fails in tension at the recess 73, thereby allowing the bottom portion 79 of the cork 70 to move downward after it fails. The bottom portion 79 of the cork 70 is that portion of the cork 70 located below the recess 73 which parts from the rest of the cork 70 that remains above the petal assembly 30 after the cork 70 fails.

Figure 5:
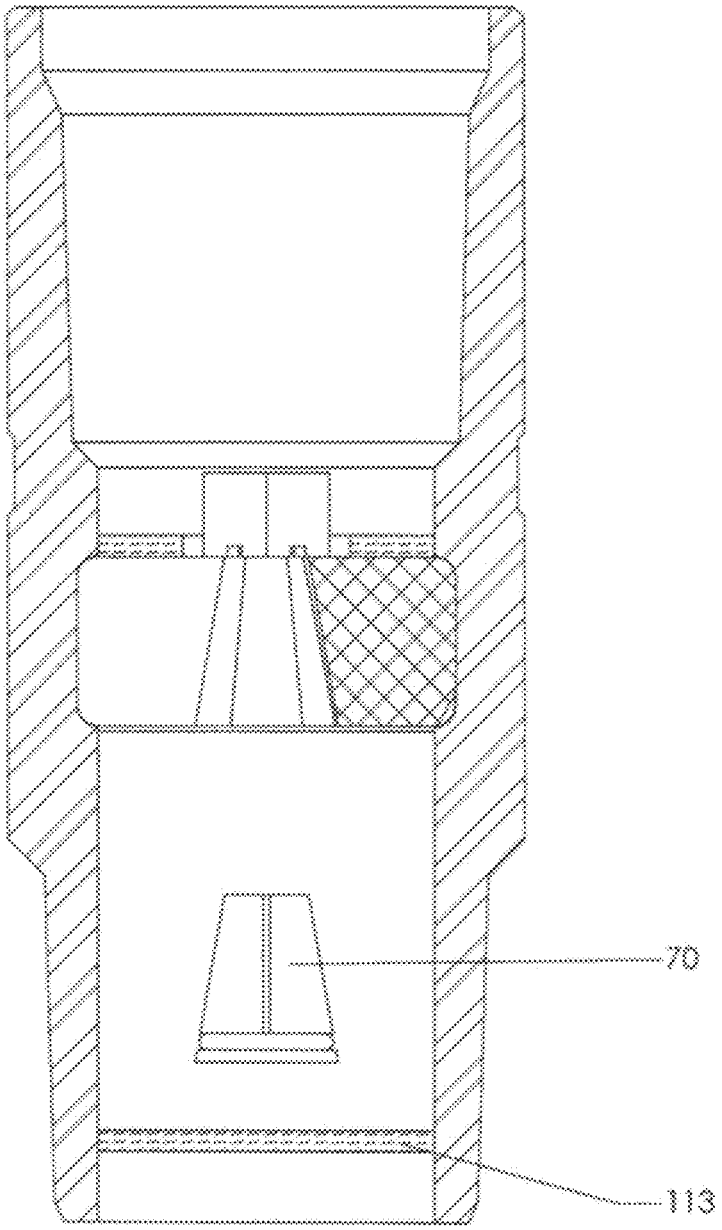
FIG. 5 is a front cross section view of the internal bidirectional tubing plug of FIG. 1 with the bottom of the failed cork and the lower piston not shown in cross section and showing the failed cork and lower piston being pushed downward out of the plug.

As illustrated in FIG. 5, once the cork 70 has parted, well fluids from above the plug 1 displace the bottom portion 79 of the cork 70 and the lower piston 113 downward and away from the petal assembly 30.

Figure 6:
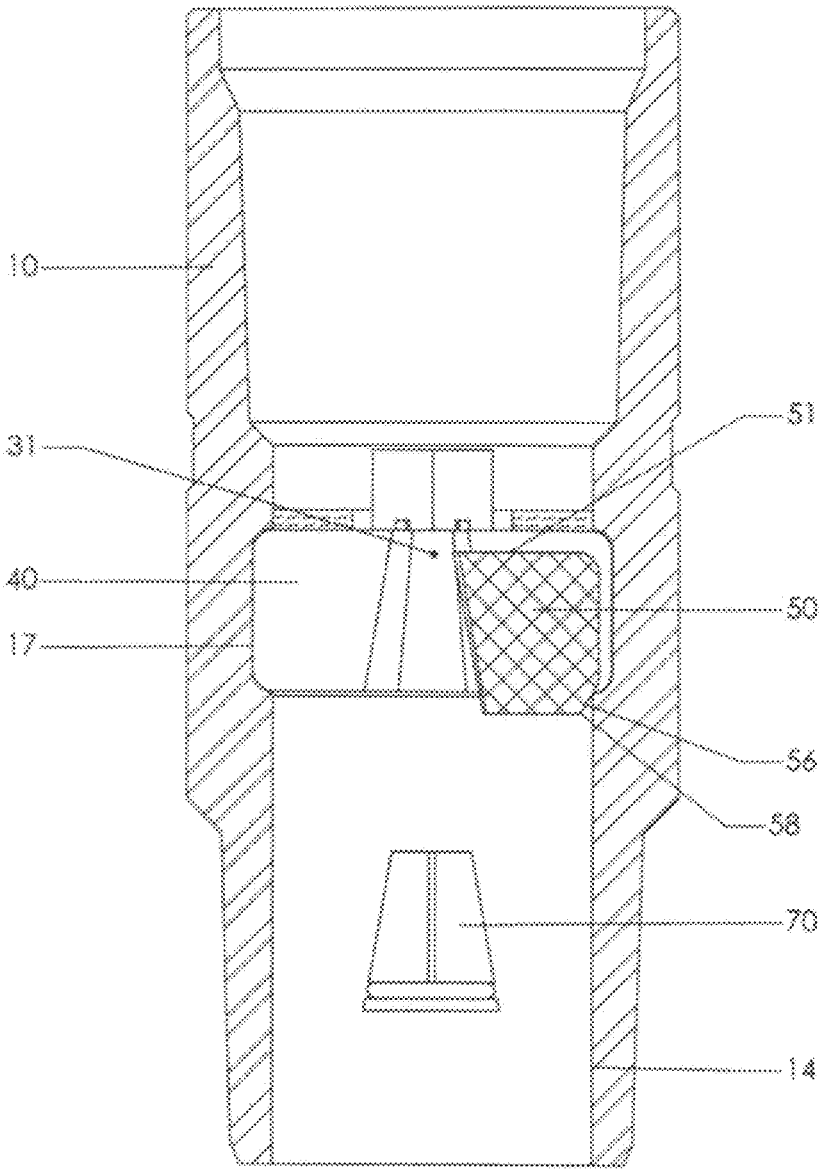
FIG. 6 is a front cross section view of the internal bidirectional tubing plug of FIG. 5 shown with the keystone petal being displaced.

Referring also to FIG. 6, after the bottom portion 79 of the cork 70 has been displaced from the petal assembly 30, fluid flow through the hole 31 in the petal assembly 30 generates a differential pressure across the petals 40, 50, 120, and 130 of the petal assembly 30. This differential pressure acts on the upper surface or top 51 of the keystone petal 50, generating a downward force that forces the keystone petal 50 inward out of the body recess due to its bevel 56 and downward out of the petal assembly 30. The inner lip 58 of the keystone petal 50 has an inside diameter this is less than the inside diameter 14 of the body 10. This allows the bevel 56 of the keystone petal 50 to ride against the inside diameter 14 of the body 10, forcing the keystone petal 50 downward and inward and ultimately out of the petal assembly 30. This leaves a space or gap in the petal assembly 30 where the keystone petal 50 had been. This resulting space and fluid flow through the remainder of the petal assembly 30 allows the remaining petals 40, 120, and 130 of the petal assembly 30 to be swept downward in cascading fashion and out of the petal recess 17 of the body 10, leaving only the open body 10 as shown in FIG. 7.

Figure 17:
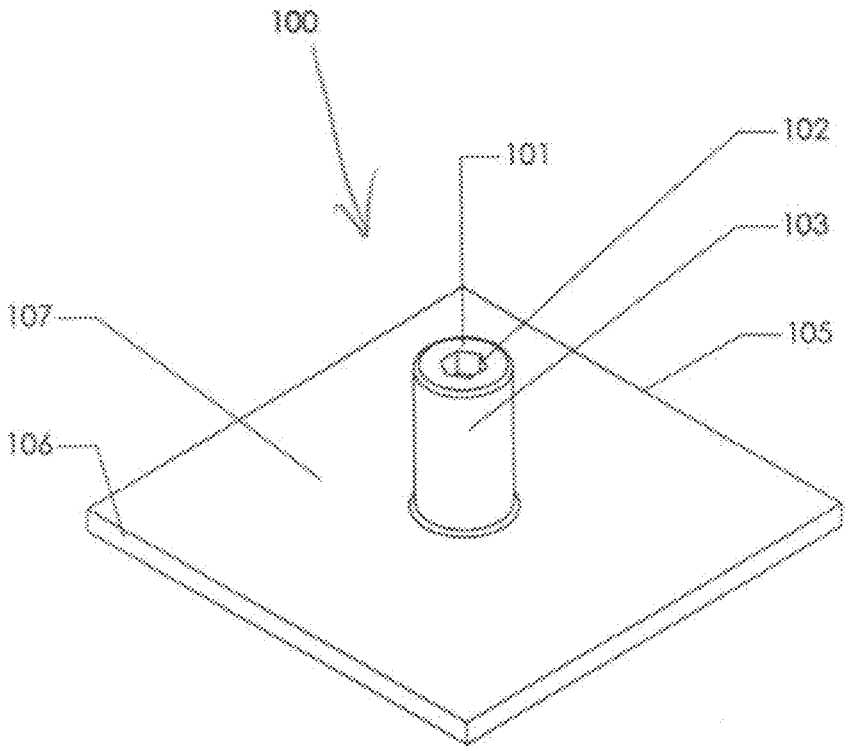
FIG. 17 is an isometric view of the assembly device for assembling the plug of FIG. 1.

Referring now to FIGS. 17-23, initial assembly of the plug 1 will be described. In order to initially assembly the plug 1 for use, it is necessary to employ an assembly device 100. As shown in FIG. 17, the assembly device 100 consists of a base plate 105 having a top 107, sides 106, and a center post 103 oriented perpendicular to the base plate 105. The top 101 of the post 101 is provided with a nut socket 102 that receives the nut 90 therein.

Figure 18:
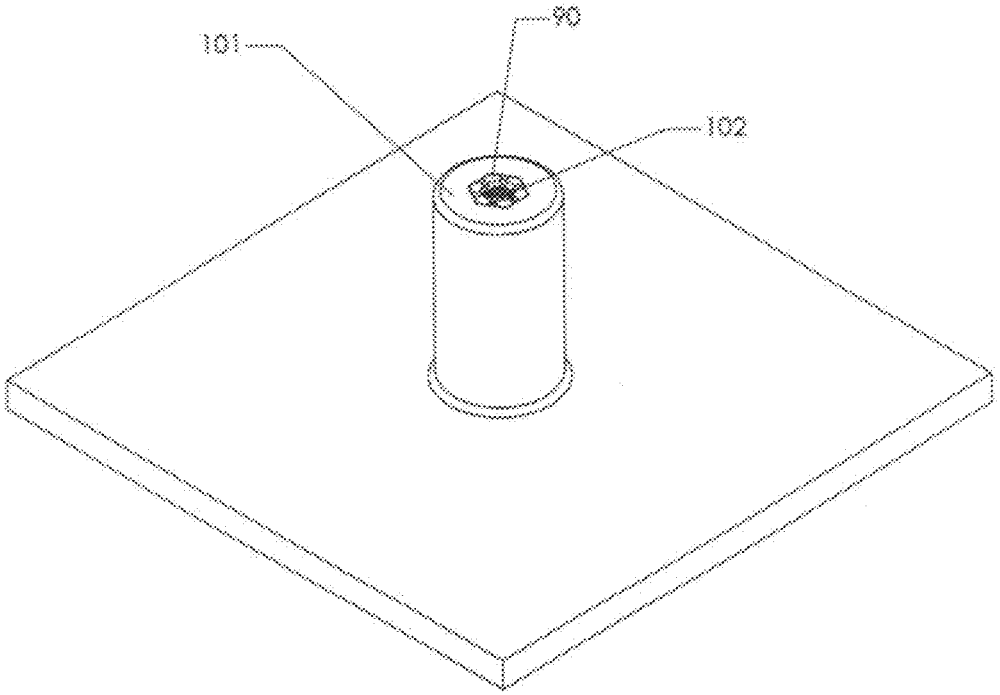
FIG. 18 is an isometric view of the assembly device of FIG. 17 shown with a nut from the cork assembly in place on the assembly device.
Figure 19:
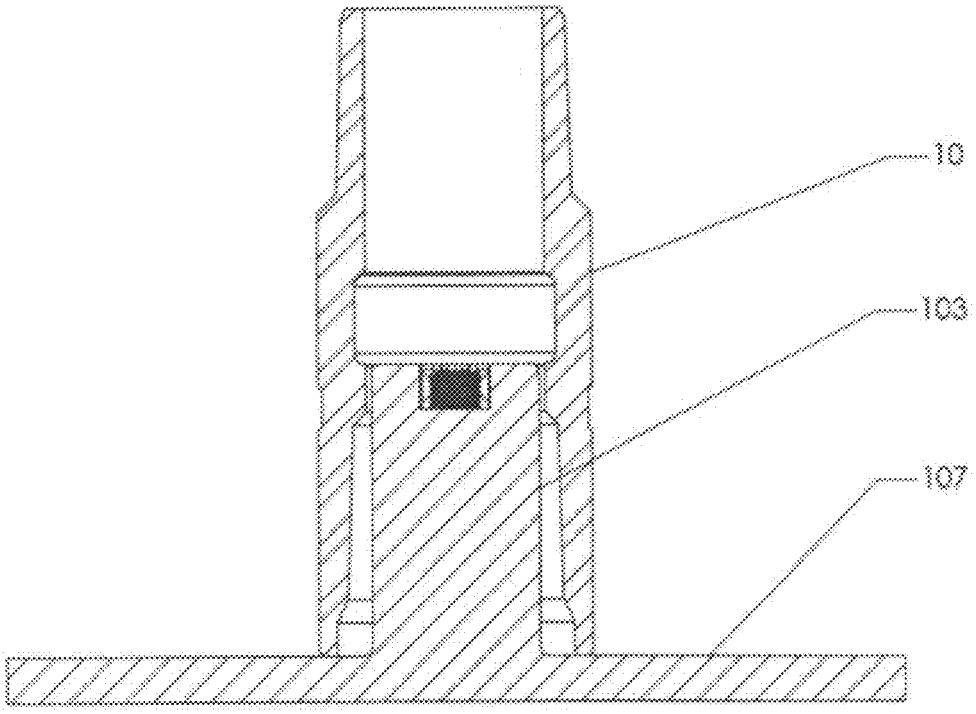
FIG. 19 is a front cross sectional view of the assembly device, with a nut in place on the assembly device and a body of the plug positioned over the assembly device.

To assembly the plug 1, first the nut 90 is inserted into the nut socket 102 of the assembly device 100 so that the slots 94 of the nut 90 are facing up, as shown in FIG. 18. Next, as illustrated in FIG. 19, the top 11 of the body 10 is placed over the post 101 and is lowered down against the top 107 of the base plate 107.

Figure 20:
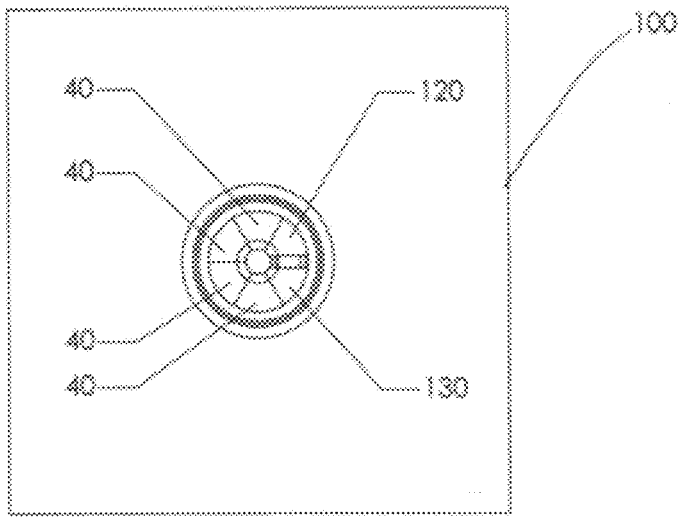
FIG. 20 is a top plan view of the assembly device of FIG. 19 shown with a nut in place on the assembly device and a body of the plug positioned over the assembly device and with all of the petals of the petal assembly in place except for the keystone petal.
Figure 20A:
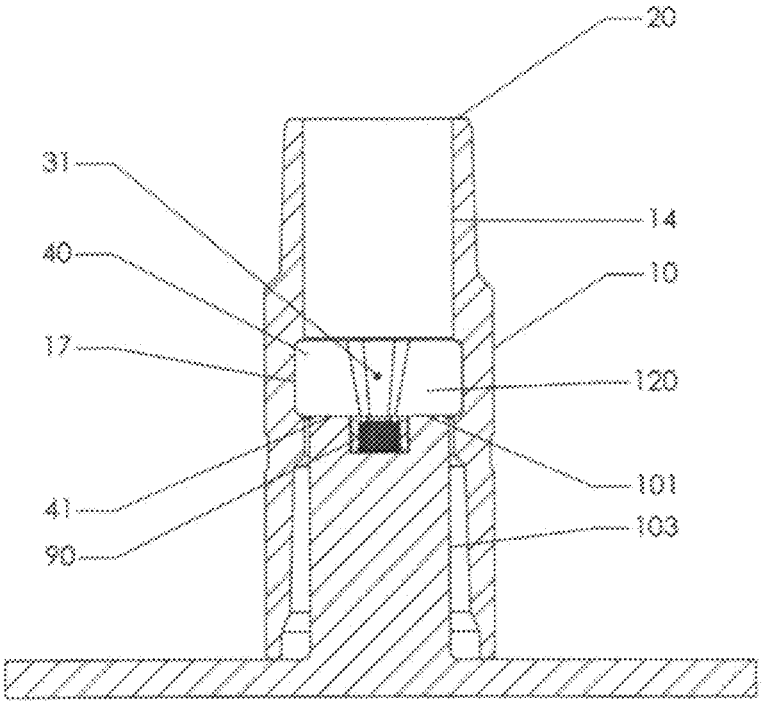
FIG. 20A is a front cross sectional view of the assembly device of FIG. 20.

Then, as illustrated in FIGS. 20 and 20A, the tops 41 of the four identical petals 40 are sequentially inserted through the bottom 20 of the body 10 and then through the inside diameter 14 of the body 10 until the tops 41 of the petals 40 are in contact with the top 101 of the post 103 of the assembly device 100. Then the petals 40 are pushed outward until their backs 45 are in contact with the recess 17 of the body 10 and the upper edges 44 and the lower edges 46 of petals 40 are in contact with the upper lip 15 and lower lip 18, respectively, of the body 10. Each of the four petals 40 are inserted in this manner sequentially, with a side 42 of each petal 40 is placed in contact with a side 42 of the previously inserted petal 40 until all four petals 40 are inserted into the body 10.

Then the fifth and sixth petals 120 and 130 are likewise inserted into the body 10 on either side of the four adjacent petals 40 and are adjusted to leave room between the fifth and sixth petals 120 and 130 for the keystone petal 50 to be inserted there between. This assembly, when finished, will create the hole 31 in the petal assembly 30 for receiving the cork 70.

Figure 21:
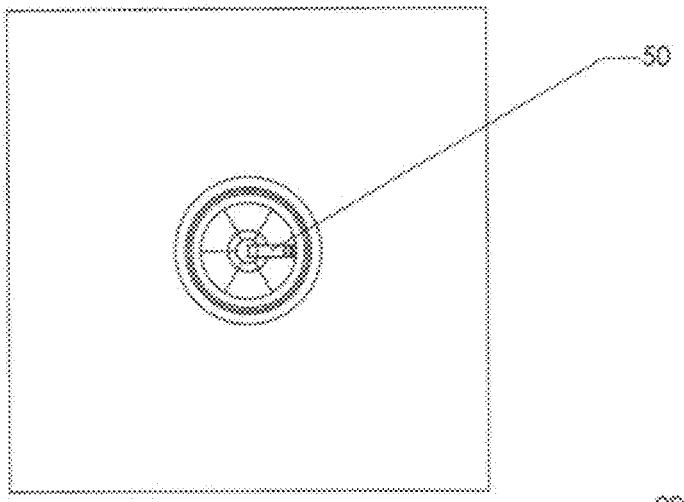
FIG. 21 is a top plan view of the assembly device of FIG. 20 with the keystone petal being slipped into place in the petal assembly.
Figure 21A:
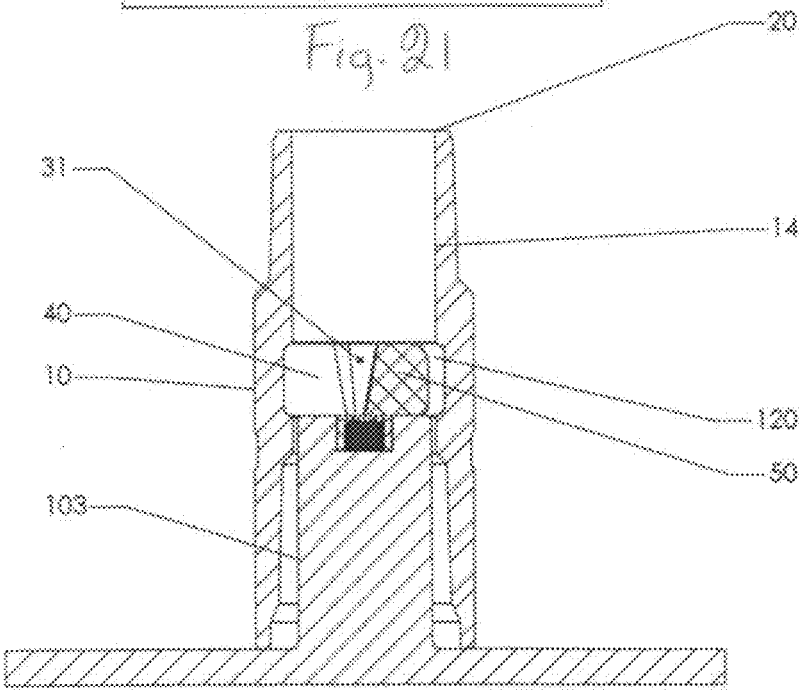
FIG. 21A is front cross section view of the assembly device of FIG. 21.

Finally, as illustrated in FIGS. 21 and 21A, the top 51 of the keystone petal 50 is inserted through the bottom 20 of the body 10 and through the inside diameter 14 of the body 10 until the top 51 of the keystone petal 50 is in contact with the top 101 of the post 103 of the assembly device 100 which places the sides 55 of the keystone petal 50 in sliding contact with the side 122 of the fifth petal 120 and with the side 132 of the sixth petal 130. The back 54 of the keystone petal 50 slides down the inside diameter 14 of the body 10 until the bottom 57 of the keystone petal 50 is in contact with the top 101 of the post 103 of the assembly device 100, through the hole 31 in the petal assembly 30. Next, the back 54 of the keystone petal 50 is pushed outward until the back 54 is in contact with the recess 17 of the body 10.

Figure 22:
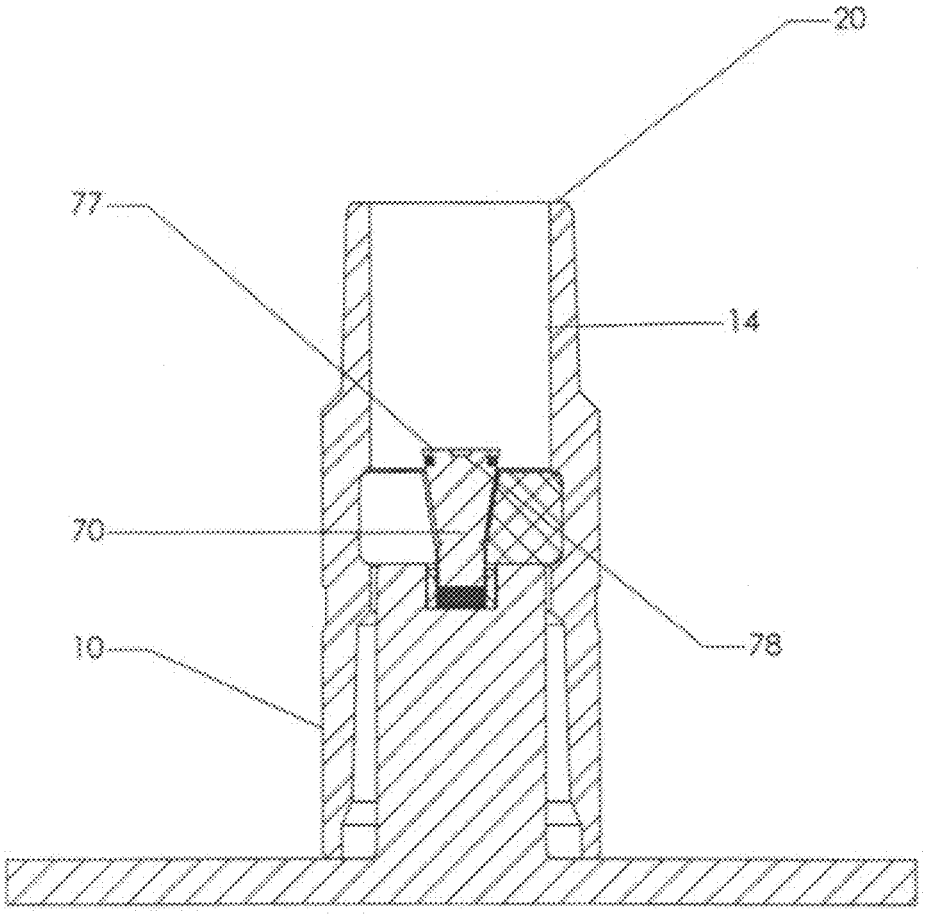
FIG. 22 is a front cross section view of the assembly device of FIG. 21 shown with the cork partially screwed into the nut.
Figure 23:
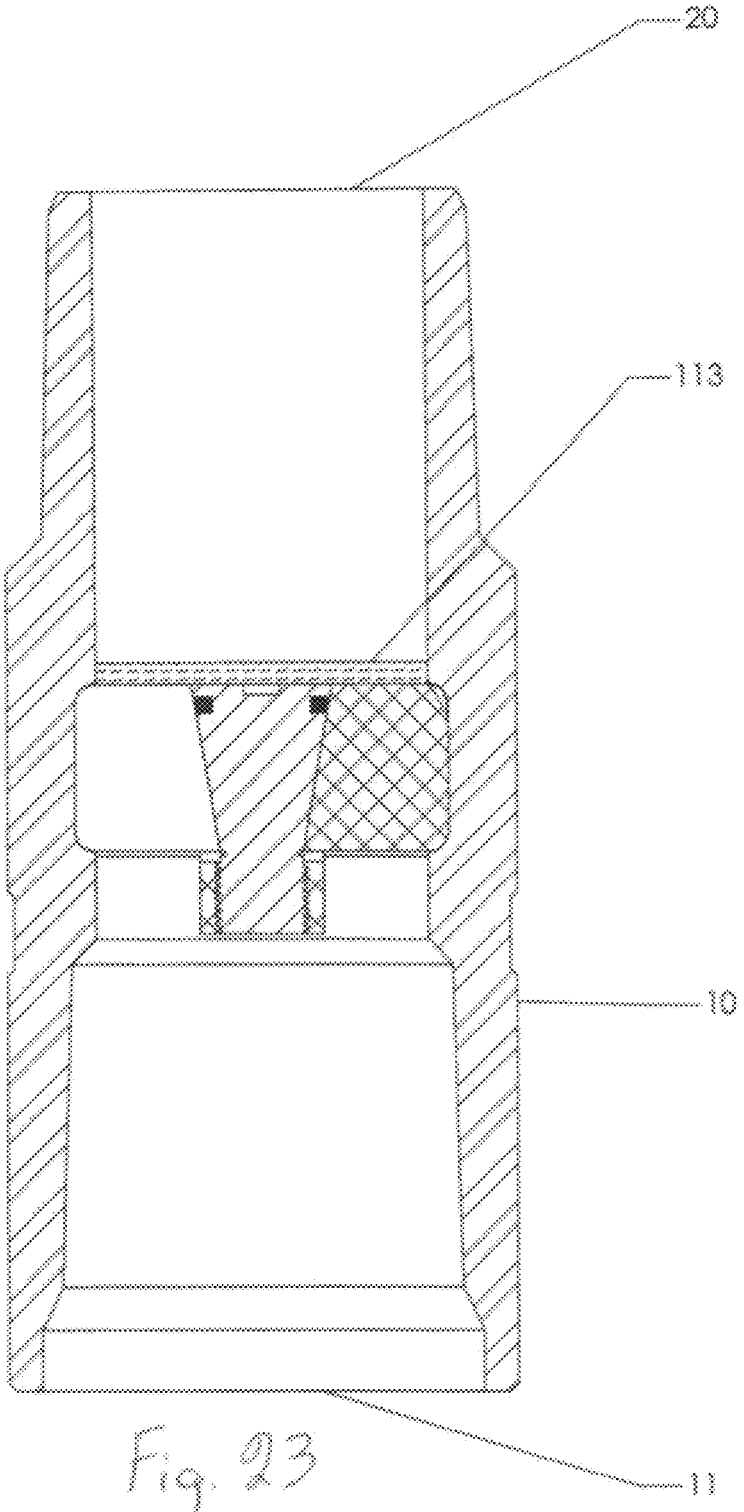
FIG. 23 is a front cross section view of the plug shown in FIG. 22 that has been removed from the assembly device and with the cork fully screwed into the nut and the lower piston inserted into the bottom of the plug.

As shown in FIG. 22, the top 71 of the cork 70 is then inserted through the bottom 20 and the inside diameter 14 of the body 10 until the threads 72 of the cork 70 engage the threads 92 of the nut 90. The cork 70 is then rotated by a screw driver device (not shown) that inserts into slot 78 of the cork 70 until the bottom 77 of the cork 70 is even with the bottoms 47 of the petals 40. Next, as shown in FIG. 23, the top 11 of the body 10 is removed from the assembly device 100 and is placed on a flat surface. A lower piston 113 is then attached to the bottoms 47, 57, 127, and 137 of the petals 40, 50, 120, and 130 and the bottom 77 of the cork 70 by friction fit. The body 10 is then rotated 180 degrees so that the bottom 20 of the body 10 rests on a flat surface. The upper piston 112 is then attached to the tops 41, 51, 121, and 131 of the petals 40, 50, 120, and 130 in a similar manner.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. An internal bidirectional tubing plug comprising:

a body which contains threads on an upper end and on a lower end as a means for connecting with a tubing string, said body housing a petal assembly, a cork assembly located within a hole provided in the petal assembly, and said petal and cork assemblies sandwiched between upper and lower pistons within the body, said petal assembly including several identical petals located adjacent each other within a petal recess provided within the body, fifth and sixth petals located adjacent the several identical petals within the petal recess, and a keystone petal located between the fifth and sixth petals within the petal recess.

2. An internal bidirectional tubing plug according to claim 1 further comprising:

inner surfaces on each petal jointly forming the hole in the petal assembly for receiving the cork assembly.

3. An internal bidirectional tubing plug according to claim 1 wherein the cork assembly further comprises:

a cork, one end of the cork having threads, a nut with threads that match in mating fashion with the threads of the cork, a recess provided in the cork adjacent the threads as a place where the cork will fail under hydraulic stress, and an o-ring that resides in an o-ring groove provided at the opposite end of the cork.

4. An internal bidirectional tubing plug according to claim 3 further comprising:

a bottom of the cork provided with a slot that is used to screw the cork into the nut, and a vertical fluid groove provided on the side of the cork.

5. An internal bidirectional tubing plug according to claim 4 further comprising:

a bottom of the nut provided with horizontal slots that direct hydraulic pressure to the vertical fluid groove provided on the cork.

6. An internal bidirectional tubing plug according to claim 1 wherein there are four identical petals in the petal assembly.

7. An internal bidirectional tubing plug according to claim 6 further comprising:

tapered conical inner surfaces provided on each petal jointly forming the hole in the petal assembly for receiving the cork assembly.

8. An internal bidirectional tubing plug according to claim 7 wherein the cork is frusto-conical shaped with a small end and an opposite large end.

9. An internal bidirectional tubing plug according to claim 8 further comprising:

threads provided on the small end of the cork.

10. An internal bidirectional tubing plug according to claim 9 further comprising:

an o-ring that resides in an o-ring groove provided at the large end of the cork.

11. An internal bidirectional tubing plug according to claim 1 wherein said keystone petal is provided with an angled bevel on the lower end of its back wall so that once the cork assembly has exited the petal assembly, pressure acting on top of the keystone petal pushes it downward and the angled bevel forces it to move inward and downward into the space vacated by the cork assembly until it exits the petal assembly and thus provides room for the other petals to cascade downward out of the body.

12. A method for removing internal components from an internal bidirectional tubing plug installed in a tubing string within a well comprising:

pumping fluid into the tubing string to fill the area above an internal bidirectional tubing plug installing in the tubing string, applying hydraulic pressure in an upper area of the plug causing the hydraulic pressure to act through a fluid path provided in the cork assembly of the plug and causing the cork to fail in tension at a recess provided in the cork, continuing to apply hydraulic pressure on the upper area of the plug to force the lower portion of the failed plug and a bottom piston out of the body of the plug, continuing to apply hydraulic pressure on the upper area of the plug to force out of the body sequentially the keystone petal, the remaining petals, the nut with attached upper portion of the failed cork, and the upper piston.

13. A method of assembling an internal bidirectional tubing plug for installing in a tubing string within a well comprising:

inserting a nut into a nut socket provided on a center post of an assembly device supported on a base plate of the assembly device so that slots provided in the nut face up, placing the body of the plug over the post and is lowering the body down so that it rests on the base plate, sequentially inserting the four identical petals and the fifth and sixth petals through the bottom of the body until the top of each petal rests on the top of the post of the assembly device and pushing each petal outward until its back is in contact with the petal recess of the body and its upper and lower edges are in contact with the upper and lower lips, respectively, of the body so that the four identical petals are adjacent to each other with the fifth and sixth petals on either side and adjacent to the four identical petals, inserting the keystone petal through the bottom of the body until the top of the keystone petal rests on the top of the post of the assembly device and pushing the keystone petal outward until its back is in contact with the petal recess of the body so that the keystone petal is located between the fifth and sixth petal and a hole is formed in the middle of the petals, inserting a cork through the bottom of the body and through the hole formed in the middle of the petals until the threads of the cork engage the threads of the nut, rotating the cork until the bottom of the cork is even with the bottoms of the petals, removing the body from the assembly device and placing the top of the body on a flat surface, attaching a lower piston to the bottoms of the petals and the cork, and rotating the body 180 degrees and attaching an upper piston to the tops of the petals.

* * * * *